US010221696B2

(12) United States Patent
Weber et al.

(10) Patent No.: US 10,221,696 B2
(45) Date of Patent: Mar. 5, 2019

(54) COOLING CIRCUIT FOR A MULTI-WALL BLADE

(71) Applicant: General Electric Company, Schenectady, NY (US)

(72) Inventors: David Wayne Weber, Simpsonville, SC (US); Lana Maria Osusky, Rexford, NY (US)

(73) Assignee: General Electric Company, Schenectady, NY (US)

( * ) Notice: Subject to any disclaimer, the term of this patent is extended or adjusted under 35 U.S.C. 154(b) by 295 days.

(21) Appl. No.: 15/239,930

(22) Filed: Aug. 18, 2016

(65) Prior Publication Data

US 2018/0051573 A1 Feb. 22, 2018

(51) Int. Cl.
*F01D 5/18* (2006.01)
*F01D 25/12* (2006.01)

(52) U.S. Cl.
CPC ..... *F01D 5/187* (2013.01); *F01D 25/12* (2013.01); *F05D 2250/185* (2013.01); *F05D 2260/201* (2013.01); *F05D 2260/202* (2013.01)

(58) Field of Classification Search
CPC ..... F01D 5/183; F01D 5/186; F01D 5/187; F01D 5/188
See application file for complete search history.

(56) References Cited

U.S. PATENT DOCUMENTS 3,191,908 A * 6/1965 Petrie ..... F01D 5/187 416/96 R
4,474,532 A 10/1984 Pazder
4,500,258 A 2/1985 Dodd et al.
4,650,399 A 3/1987 Craig et al.
(Continued)

FOREIGN PATENT DOCUMENTS

EP 1 065 343 A2 1/2001
EP 2 022 941 A2 2/2009
(Continued)

OTHER PUBLICATIONS

U.S. Appl. No. 14/977,270, Office Action dated Mar. 21, 2018, 42 pages.
(Continued)

*Primary Examiner* — Andrew H Nguyen
(74) *Attorney, Agent, or Firm* — Ernest G. Cusick; Hoffman Warnick LLC

(57) ABSTRACT

A cooling circuit for a multi-wall blade according to an embodiment includes: a pressure side cavity with a surface adjacent a pressure side of the multi-wall blade; a suction side cavity with a surface adjacent a suction side of the multi-wall blade; a central cavity disposed between the pressure side and suction side cavities, the central cavity including no surfaces adjacent the pressure and suction sides of the multi-wall blade; a first leading edge cavity with surfaces adjacent the pressure and suction sides of the multi-wall blade, the first leading edge cavity located forward of the central cavity; a second leading edge cavity located forward of the first leading edge cavity; at least one impingement opening for fluidly coupling the first leading edge cavity to the second leading edge cavity; and at least one channel for fluidly coupling the central cavity to a tip of the multi-wall blade.

20 Claims, 5 Drawing Sheets

(56) References Cited

U.S. PATENT DOCUMENTS 4,753,575 A 6/1988 Levengood et al.
5,296,308 A 3/1994 Caccavale et al.
5,356,265 A 10/1994 Kercher
5,382,135 A 1/1995 Green
5,403,159 A 4/1995 Green et al.
5,654,700 A 8/1997 Prata et al.
5,702,232 A 12/1997 Moore
5,813,835 A * 9/1998 Corsmeier ..... F01D 5/186 415/115
5,853,044 A 12/1998 Wheaton et al.
6,019,579 A 2/2000 Fukuno et al.
6,196,792 B1 3/2001 Lee et al.
6,220,817 B1 4/2001 Durgin et al.
6,264,428 B1 7/2001 Dailey et al.
6,416,284 B1 7/2002 Demers et al.
6,478,535 B1 11/2002 Chung et al.
6,491,496 B2 12/2002 Starkweather
6,705,836 B2 3/2004 Bourriaud et al.
6,887,033 B1 5/2005 Phillips et al.
6,916,155 B2 7/2005 Eneau et al.
6,974,308 B2 12/2005 Halfmann et al.
7,104,757 B2 9/2006 Gross
7,217,097 B2 5/2007 Liang
7,303,376 B2 12/2007 Liang
7,416,391 B2 8/2008 Veltre et al.
7,458,778 B1 * 12/2008 Liang ..... F01D 5/187 416/97 R
7,481,623 B1 1/2009 Liang
7,527,474 B1 5/2009 Liang
7,527,475 B1 5/2009 Liang
7,607,891 B2 10/2009 Cherolis et al.
7,625,178 B2 12/2009 Morris et al.
7,686,581 B2 3/2010 Brittingham et al.
7,780,413 B2 8/2010 Liang
7,780,415 B2 8/2010 Liang
7,785,072 B1 8/2010 Liang
7,819,629 B2 10/2010 Liang
7,838,440 B2 11/2010 Park
7,857,589 B1 12/2010 Liang
7,862,299 B1 1/2011 Liang
7,901,183 B1 3/2011 Liang
7,914,257 B1 3/2011 Liang
7,980,822 B2 7/2011 Cunha et al.
8,011,888 B1 9/2011 Liang
8,047,790 B1 11/2011 Liang
8,057,183 B1 11/2011 Liang
8,087,891 B1 1/2012 Liang
8,157,505 B2 4/2012 Liang
8,292,582 B1 10/2012 Liang
8,444,386 B1 5/2013 Liang
8,459,103 B2 6/2013 Khibnik et al.
8,471,730 B2 6/2013 Tillotson
8,616,845 B1 12/2013 Liang
8,666,570 B1 3/2014 Tillotson
8,678,766 B1 3/2014 Liang
8,734,108 B1 5/2014 Liang
8,869,537 B2 10/2014 Geis et al.
8,869,603 B2 10/2014 Epstein et al.
9,010,198 B2 4/2015 Rajamani et al.
9,041,926 B2 5/2015 Ray et al.
9,222,873 B2 12/2015 Baumgardner et al.
10,054,055 B2 8/2018 Spangler et al.
2003/0223862 A1 12/2003 DeMarche et al.
2005/0008487 A1 1/2005 Lee et al.
2005/0031452 A1 2/2005 Liang
2005/0226726 A1 10/2005 Lee et al.
2006/0222495 A1 10/2006 Liang
2007/0128031 A1 6/2007 Liang
2007/0128032 A1 6/2007 Lee et al.
2007/0189896 A1 8/2007 Itzel et al.
2008/0118366 A1 5/2008 Correia et al.
2008/0175714 A1 7/2008 Spangler et al.
2009/0104042 A1 4/2009 Liang
2009/0175733 A1 7/2009 Poon et al.
2010/0104419 A1 4/2010 Liang
2011/0123310 A1 5/2011 Beattie et al.
2011/0236221 A1 9/2011 Campbell
2012/0082566 A1 4/2012 Ellis et al.
2012/0207614 A1 * 8/2012 Lee ..... F01D 5/186 416/97 R
2013/0171003 A1 7/2013 Ellis et al.
2014/0053629 A1 2/2014 Cahill
2014/0096538 A1 4/2014 Boyer et al.
2014/0157872 A1 6/2014 Welland et al.
2015/0059355 A1 3/2015 Feigl et al.
2015/0110641 A1 4/2015 Herzlinger et al.
2015/0184519 A1 7/2015 Foster et al.
2015/0184538 A1 7/2015 Smith
2015/0322008 A1 11/2015 Hilpert et al.
2016/0194965 A1 7/2016 Spangler
2016/0312632 A1 10/2016 Hagan et al.
2016/0312637 A1 10/2016 Duguay
2017/0173672 A1 6/2017 Foster et al.
2017/0175244 A1 6/2017 Detor et al.
2017/0175443 A1 6/2017 Weber et al.
2017/0175540 A1 6/2017 Weber et al.
2017/0175541 A1 6/2017 Weber et al.
2017/0175542 A1 6/2017 Weber et al.
2017/0175544 A1 6/2017 Smith et al.
2017/0175545 A1 6/2017 Foster et al.
2017/0175546 A1 6/2017 Smith et al.
2017/0175547 A1 6/2017 Smith et al.
2017/0175548 A1 6/2017 Smith et al.
2017/0175549 A1 6/2017 Weber et al.
2017/0175550 A1 6/2017 Smith et al.
2017/0198594 A1 7/2017 Takamura et al.
2018/0051574 A1 2/2018 Weber et al.
2018/0051575 A1 2/2018 Weber et al.
2018/0051576 A1 2/2018 Weber et al.
2018/0051577 A1 2/2018 Leary et al.

FOREIGN PATENT DOCUMENTS

EP 2037081 A1 3/2009
EP 3 184 739 A1 6/2017
JP 2002242607 A 8/2002

OTHER PUBLICATIONS

U.S. Appl. No. 14/977,124, Notice of Allowance dated Mar. 19, 2018, 21 pages.
U.S. Appl. No. 14/977,102, Office Action dated Mar. 30, 2018, 39 pages.
U.S. Appl. No. 14/977,152, Office Action 1 dated Sep. 14, 2017, 15 pages.
U.S. Appl. No. 14/977,124, Office Action 1 dated Oct. 10, 2017, 15 pages.
U.S. Appl. No. 14/977,175, Office Action 1 dated Nov. 24, 2017, 25 pages.
U.S. Appl. No. 14/977,200, Office Action dated Dec. 19, 2017, 23 pages.
U.S. Appl. No. 14/977,152, Final Office Action 1 dated Dec. 26, 2017, 15 pages.
Carn, S.A., et al., "Tracking volcanic sulfur dioxide clouds for aviation hazard mitigation," Natural Hazards, vol. 51, Issue 2, pp. 325-343 (Nov. 2009).
Dunn, M.G., et al., "Performance Deterioration of a Turbofan and a Turbojet Engine Upon Exposure to a Dust Environment," Journal of Engineering for Gas Turbines and Power, vol. 109, Issue 3, pp. 336-343 (Jul. 1987).
Hill, K., "The Kopp-Etchells Effect Explained," Science-Based Life, Retrieved from internet URL: https://sciencebasedlife.wordpress.com/2012/11/01/the-kopp-etchells-effect/, on Apr. 26, 2018 pp. 1-8 (Nov. 1, 2012).
Mackay, A., "The Physics of helicopter blade scintillation and some possible methods of investigation," Q-par Angus Ltd., Barons Cross Laboratories Leominster Herefordshire HR6 HRS UK, pp. 1-15 (Feb. 2010).
Mather, T.A. and Harrison, R.G., "Electrification of volcanic plumes," Surveys in Geophysics, vol. 27, Issue 4, pp. 387-342 (Jul. 2006).

(56) References Cited

OTHER PUBLICATIONS

Wescott, E.M., et al., "The optical spectrum of aircraft St. Elmo's fire," Geophysical Research Letters, vol. 23, Issue 25, pp. 3687-3690 (Dec. 15, 1996).
Extended European Search Report and Opinion issued in connection with corresponding EP Application No. 17186706.2 dated Jan. 29, 2018.
U.S. Appl. No. 14/977,270, Notice of Allowance dated Jul. 13, 2018, 24 pages.
EP Search Report and Written Opinion for corresponding EP Patent Application No. 16203125.6 dated Apr. 28, 2017, 7 pages.
U.S. Appl. No. 14/977,102, Notice of Allowance dated Jul. 17, 2018, 18 pages.
U.S. Appl. No. 14/977,078, Office Action dated Apr. 19, 2018, 39 pages.
U.S. Appl. No. 14/977,200, Notice of Allowance dated May 2, 2018, 18 pages.
U.S. Appl. No. 14/977,228, Notice of Allowance dated Feb. 12, 2018, 34 pages.
U.S. Appl. No. 14/977,247, Notice of Allowance dated Feb. 12, 2018, 24 pages.
U.S. Appl. No. 15/239,968, Office Action dated Aug. 27, 2018, 42 pages.
U.S. Appl. No. 15/239,940, Office Action dated Aug. 27, 2018, 41 pages.
U.S. Appl. No. 15/239,985, Office Action dated Aug. 29, 2018, 40 pages.
U.S. Appl. No. 14/977,078, Notice of Allowance dated Sep. 20, 2018, 22 pages.
U.S. Appl. No. 15/239,994, Office Action dated Dec. 10, 2018, 13 pages.
U.S. Appl. No. 15/239,968, Notice of Allowance dated Dec. 12, 2018, 18 pages.
U.S. Appl. No. 15/239,985, Notice of Allowance dated Dec. 12, 2018, 12 pages.
U.S. Appl. No. 15/239,940, Notice of Allowance dated Dec. 28, 2018, 11 pages.

* cited by examiner

COOLING CIRCUIT FOR A MULTI-WALL BLADE

This application is related to co-pending U.S. application Ser. Nos. 14/977,078; 14/977,102; 14/977,124; 14/977,152; 14/977,175; 14/977,200; 14/977,228 14/977,247 and 14/977,270, all filed on Dec. 21, 2016 and co-pending U.S. application Ser. Nos. 15/239,968; 15/239,994; 15/5239,940 and 15/239,985, all filed on Aug. 18, 2016.

BACKGROUND OF THE INVENTION

The disclosure relates generally to turbine systems, and more particularly, to a cooling circuit for a multi-wall blade.

Gas turbine systems are one example of turbomachines widely utilized in fields such as power generation. A conventional gas turbine system includes a compressor section, a combustor section, and a turbine section. During operation of a gas turbine system, various components in the system, such as turbine blades, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

Turbine blades typically contain an intricate maze of internal cooling channels. Cooling air provided by, for example, a compressor of a gas turbine system may be passed through the internal cooling channels to cool the turbine blades.

Multi-wall turbine blade cooling systems may include internal near wall cooling circuits. Such near wall cooling circuits may include, for example, near wall cooling channels adjacent the outside walls of a multi-wall blade. The near wall cooling channels are typically small, requiring less cooling flow, while still maintaining enough velocity for effective cooling to occur. Other, typically larger, low cooling effectiveness central channels of a multi-wall blade may be used as a source of cooling air and may be used in one or more reuse circuits to colic and reroute to "spent" cooling flow for redistribution to lower heat load regions of the multi-wall blade.

BRIEF DESCRIPTION OF THE INVENTION

A first aspect of the disclosure provides a cooling circuit for a multi-wall blade, the cooling circuit including: a pressure side cavity with a surface adjacent a pressure side of the multi-wall blade; a suction side cavity with a surface adjacent a suction side of the multi-wall blade; a central cavity disposed between the pressure side and suction side cavities, the central cavity including no surfaces adjacent the pressure and suction sides of the multi-wall blade; a first leading edge cavity with surfaces adjacent the pressure and suction sides of the multi-wall blade, the first leading edge cavity located forward of the central cavity; a second leading edge cavity located forward of the first leading edge cavity; at least one impingement opening for fluidly coupling the first leading edge cavity to the second leading edge cavity; and at least one channel for fluidly coupling the central cavity to a tip of the multi-wall blade.

A second aspect of the disclosure provides an apparatus, including: a multi-wall turbine blade; and a cooling circuit disposed within the multi-wall turbine blade, the cooling circuit including: a pressure side cavity with a surface adjacent a pressure side of the multi-wall blade; a suction side cavity with a surface adjacent a suction side of the multi-wall blade; a central cavity disposed between the pressure side and suction side cavities, the central cavity including no surfaces adjacent the pressure and suction sides of the multi-wall blade; a first leading edge cavity with surfaces adjacent the pressure and suction sides of the multi-wall blade, the first leading edge cavity located forward of the central cavity; a second leading edge cavity located forward of the first leading edge cavity; at least one impingement opening for fluidly coupling the first leading edge cavity to the second leading edge cavity; and at least one channel for fluidly coupling the central cavity to a tip of the multi-wall blade.

A third aspect of the disclosure provides a turbomachine, including: a gas turbine system including a compressor component, a combustor component, and a turbine component, the turbine component including a plurality of turbomachine blades, and wherein at least one of the turbomachine blades includes a multi-wall blade; and a cooling circuit disposed within the multi-wall blade, the cooling circuit including: a pressure side cavity with a surface adjacent a pressure side of the multi-wall blade; a suction side cavity with a surface adjacent a suction side of the multi-wall blade; a central cavity disposed between the pressure side and suction side cavities, the central cavity including no surfaces adjacent the pressure and suction sides of the multi-wall blade; a first leading edge cavity with surfaces adjacent the pressure and suction sides of the multi-wall blade, the first leading edge cavity located forward of the central cavity; a second leading edge cavity located forward of the first leading edge cavity; at least one impingement opening for fluidly coupling the first leading edge cavity to the second leading edge cavity; and at least one channel for fluidly coupling the central cavity to a tip of the multi-wall blade.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure.

Figure 1:
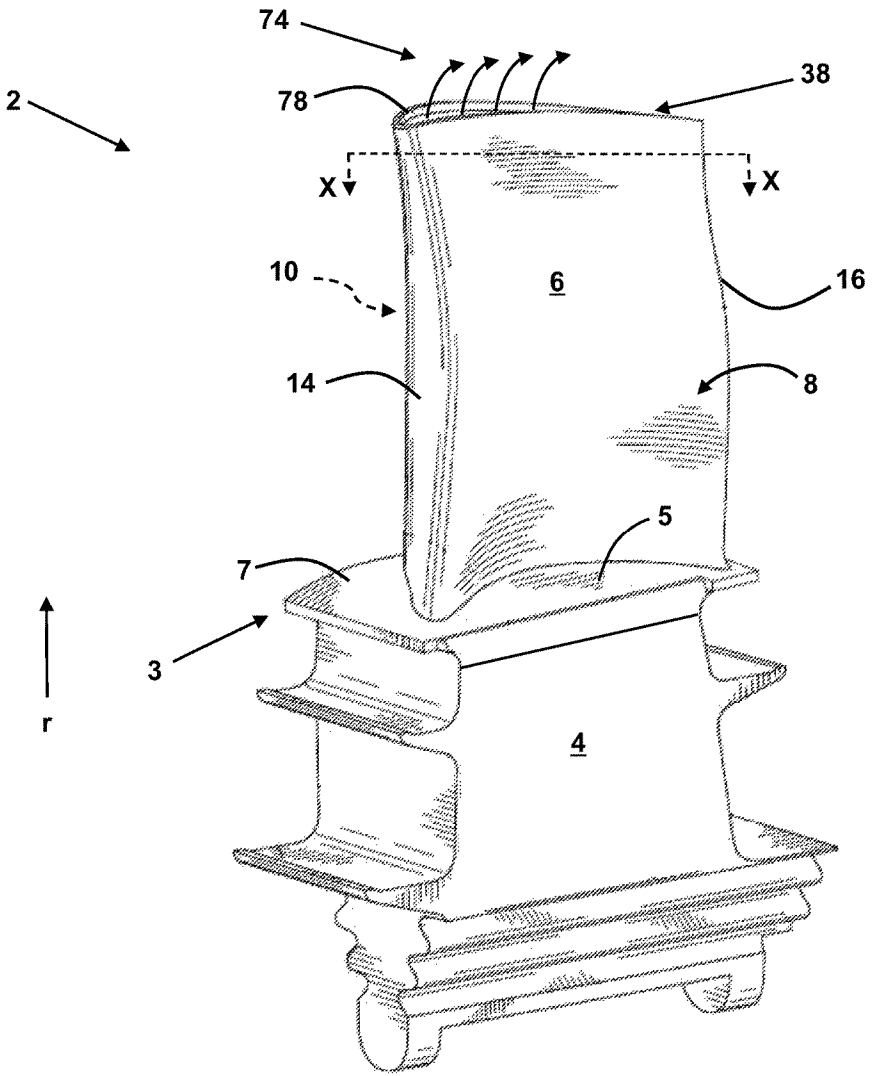
FIG. 1 shows a perspective view of a multi-wall blade according to embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated above, the disclosure relates generally to turbine systems, and more particularly, to a cooling circuit for cooling a multi-wall blade.

In the Figures (see, e.g., FIG. 6), the "A" axis represents an axial orientation. As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along an axis "r" (see, e.g., FIG. 1), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location.

Turning to FIG. 1, a perspective view of a turbomachine blade 2 is shown. The turbomachine blade 2 includes a shank 4 and a multi-wall blade 6 coupled to and extending radially outward from the shank 4. The multi-wall blade 6 includes a pressure side 8, an opposed suction side 10, and a tip area 38. The multi-wall blade 6 further includes a leading edge 14 between the pressure side 8 and the suction side 10, as well as a trailing edge 16 between the pressure side 8 and the suction side 10 on a side opposing the leading edge 14. The multi-wall blade 6 extends radially away from a platform 3 including a pressure side platform 5 and a suction side platform 7.

The shank 4 and multi-wall blade 6 may each be formed of one or more metals (e.g., nickel, alloys of nickel, etc.) and may be formed (e.g., cast, forged or otherwise machined) according to conventional approaches. The shank 4 and multi-wall blade 6 may be integrally formed (e.g., cast, forged, three-dimensionally printed, etc.), or may be formed as separate components which are subsequently joined (e.g., via welding, brazing, bonding or other coupling mechanism). The multi-wall blade 6 may be a stationary blade (nozzle) or a rotatable blade.

Figure 2:
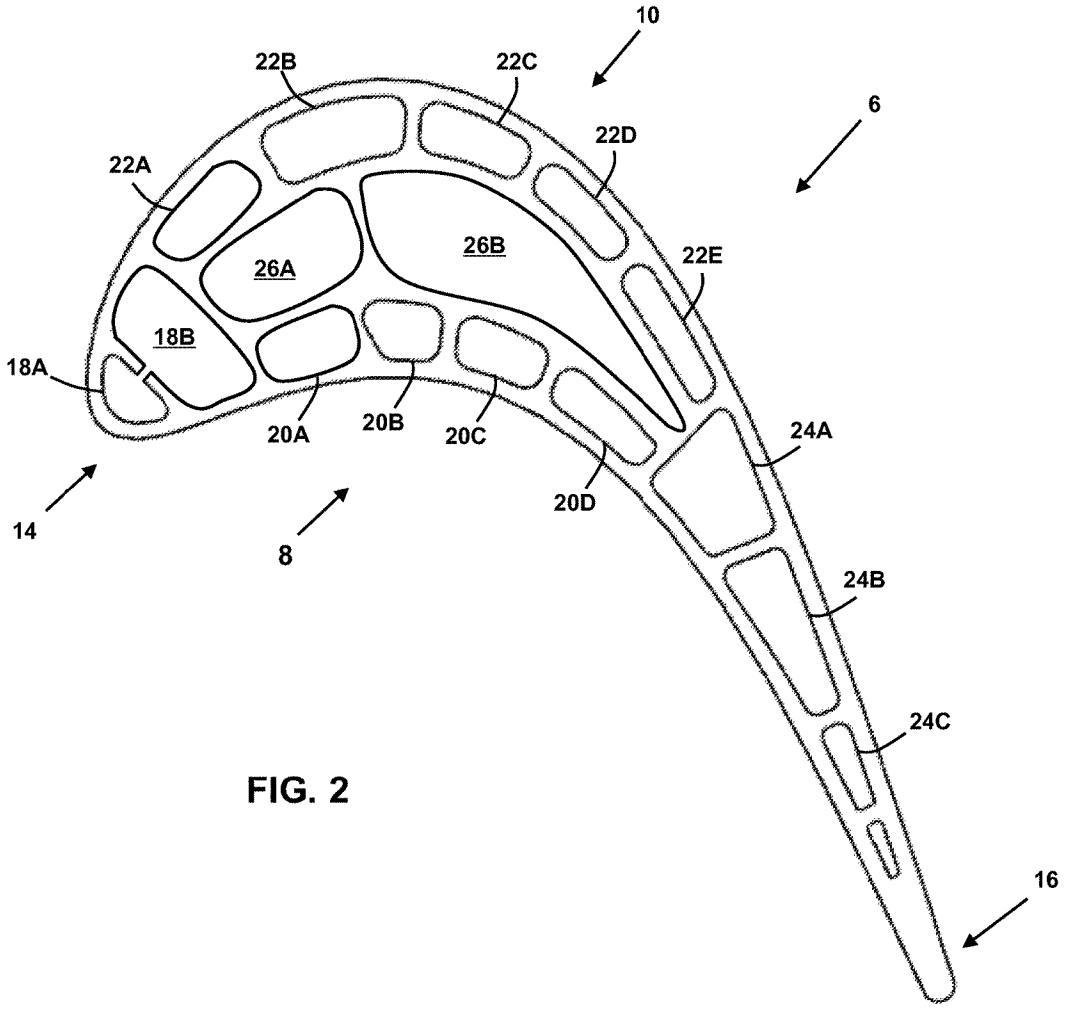
FIG. 2 is a cross-sectional view of the multi-wall blade of FIG. 1, taken along line X-X in FIG. 1 according to various embodiments.

FIG. 2 depicts a cross-sectional view of the multi-wall blade 6 taken along line X-X of FIG. 1. As shown, the multi-wall blade 6 may include a plurality of internal cavities. In embodiments, the multi-wall blade 6 includes a plurality of leading edge cavities 18A, 18B, a plurality of pressure side (outside) cavities 20A-20D, a plurality of suction side (outside) cavities 22A-22E, a plurality of trailing edge cavities 24A-24C, and a plurality of central cavities 26A, 26B. The leading edge cavity 18B is aft of the leading edge cavity 18A (closer to the trailing edge 16). The number of cavities 18, 20, 22, 24, 26 within the multi-wall blade 6 may vary, of course, depending upon for example, the specific configuration, size, intended use, etc., of the multi-wall blade 6. To this extent, the number of cavities 18, 20, 22, 24, 26 shown in the embodiments disclosed herein is not meant to be limiting. According to embodiments, various cooling circuits can be provided using different combinations of the cavities 18, 20, 22, 24, 26.

Figure 4:
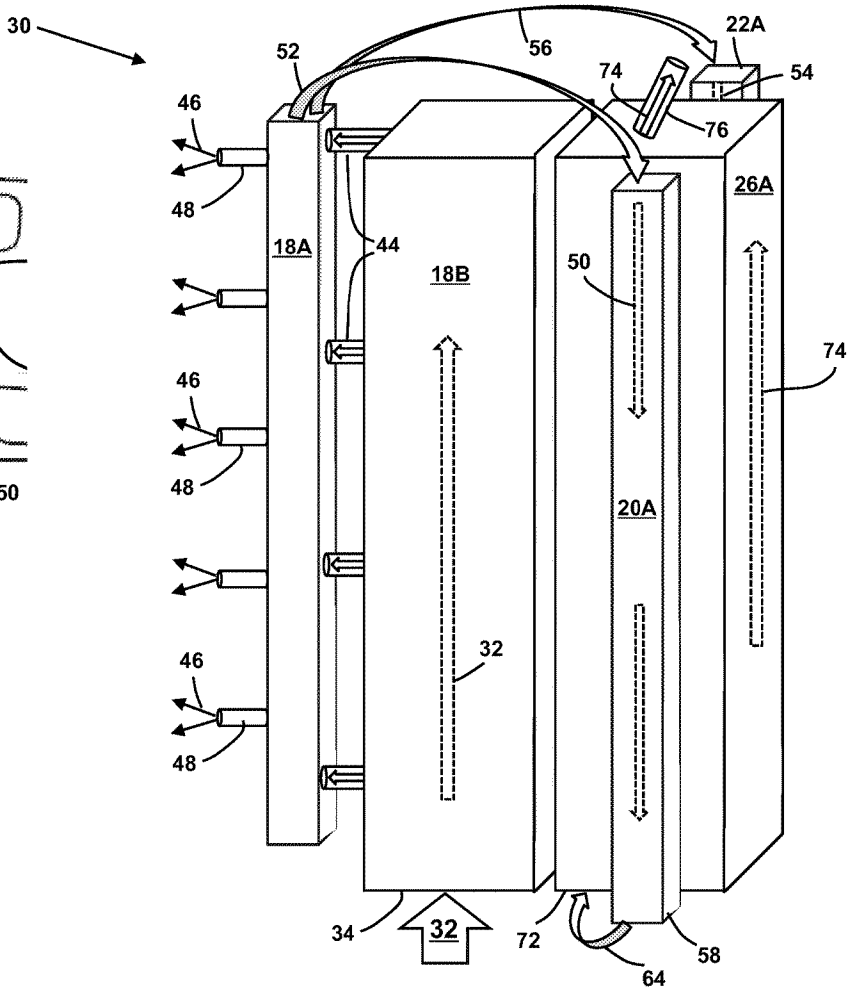
FIG. 4 is a perspective view of the leading edge cooling circuit according to various embodiments.
Figure 3:
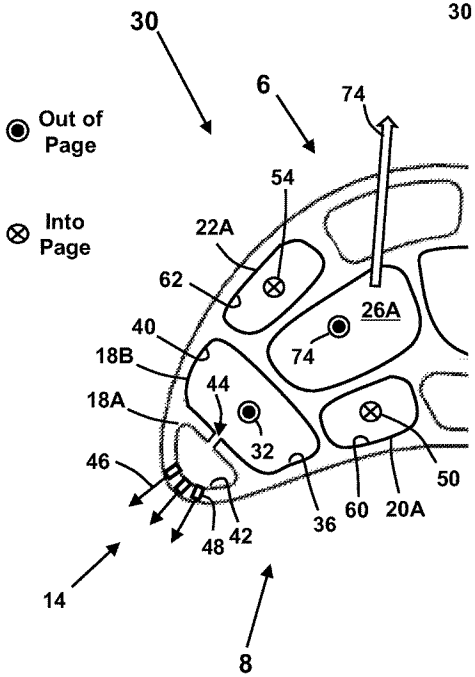
FIG. 3 depicts a portion of the cross-sectional view of FIG. 2 showing a leading edge cooling circuit according to various embodiments.

A leading edge serpentine cooling circuit 30 according to embodiments is depicted in FIGS. 3 and 4. As the name indicates, the leading edge cooling circuit 30 is located adjacent the leading edge 14 of the multi-wall blade 6, between the pressure side 8 and suction side 10 of the multi-wall blade 6.

Referring simultaneously to FIGS. 3 and 4, a flow of cooling air 32, generated for example by a compressor 104 of a gas turbine system 102 (FIG. 6), is fed through the shank 4 (FIG. 1) to the leading edge cooling circuit 30 (e.g., via at least one cooling air feed). The flow of cooling air 32 is fed to a base 34 of the leading edge cavity 18B. The flow of cooling air 32 flows radially outward through the leading edge cavity 18B toward a tip area 38 (FIG. 1) of the multi-wall blade 6, providing convection cooling. As shown in FIG. 3, the leading edge cavity 18B has a surface 36 adjacent the pressure side 8 of the multi-wall blade 6, and a surface 40 adjacent the suction side 10 of the multi-wall-blade 6.

After passing into the leading edge cavity 18B, the flow of cooling air 32 is directed onto the forward wall 42 of the leading edge cavity 18A via at least one impingement hole 44, providing impingement cooling. A first portion 46 of the post-impingement flow of cooling air 32 flows out of the leading edge cavity 18A to the leading edge 14 of the multi-wall blade 6 via at least one film hole 48 to provide film cooling of the leading edge 14.

As depicted in FIGS. 3 and 4, a second portion 50 of the post-impingement flow of cooling air 32 is directed by a turn 52 into the pressure side cavity 20A. In a corresponding manner, a third portion 54 of the post-impingement flow of cooling air 32 is directed by a turn 56 into the suction side cavity 22A. According to embodiments, the turns 52, 56 (as well as other turns described below) may include a conduit, tube, pipe, channel, and/or any other suitable mechanism capable of passing air or any other gas from one location to another location within the multi-wall blade 6.

The second portion 50 of the flow of cooling air 32 flows radially inward through the pressure side cavity 20A toward a base 58 of the pressure side cavity 20A, providing convection cooling. The pressure side cavity 20A includes a surface 60 adjacent the pressure side 8 of the multi-wall blade 6. The third portion 54 of the flow of cooling air 32 flows radially inward through the suction side cavity 22A toward a base (not shown) of the suction side cavity 22A, providing convection cooling. The suction side cavity 22A includes a surface 62 adjacent the suction side 10 of the multi-wall blade 6.

A turn 64 redirects the second portion 50 of the flow of cooling air 32 from the base 58 of the pressure side cavity 20A into a base 72 of the central cavity 26A. Another turn (not shown) redirects the third portion 54 of the flow of cooling air 32 from the base (not shown) of the suction side cavity 22A into the base 72 of the central cavity 26A. The second and third portions 50, 54 of the flow of cooling air 32 combine into a flow of cooling air 74, which flows radially outward through the central cavity 26A. Unlike the pressure side cavity 20A, which has a surface 60 adjacent the pressure side 8 of the multi-wall blade 6, and the suction side cavity 22A, which has a surface 62 adjacent the suction side 10 of the multi-wall-blade 6, the central cavity 26A has no surfaces adjacent either the pressure side 8 or the suction side 10 of the multi-wall blade 6.

The flow of cooling air 74 flows radially outward through the central cavity 26A toward the tip area 38 (FIG. 1) of the multi-wall blade 6. The flow of cooling air 74 flows from the central cavity 26A through at least one channel 76 and is exhausted from the tip 78 of the multi-wall blade 6 as tip film 80 to provide tip film cooling. In other embodiments, the flow of cooling air 74, or portions thereof, may be routed to cooling circuits in the tip 78 or the platform 3 (or inner/outer side walls) and/or may be reused in other cooling circuits aft of the leading edge serpentine cooling circuit 30.

Figure 5:
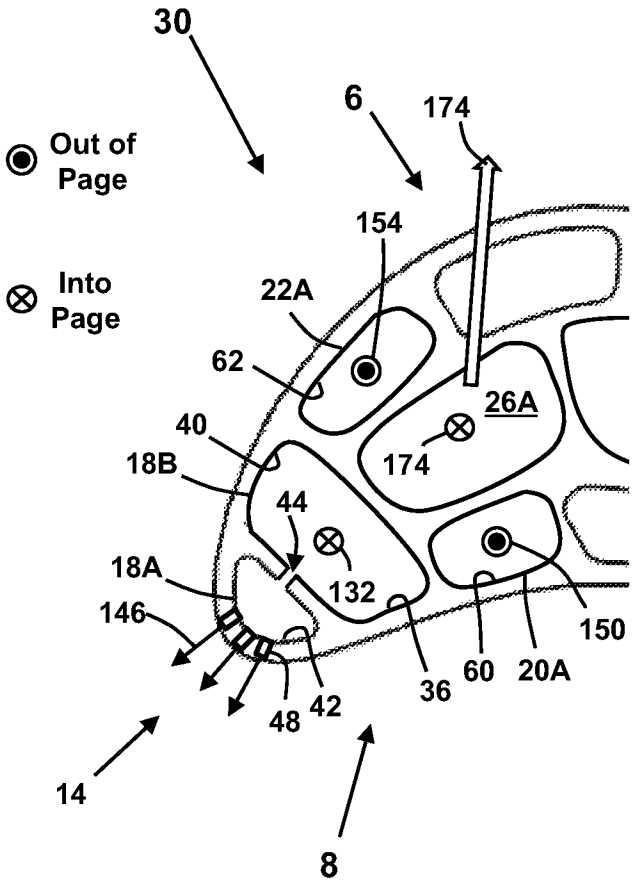
FIG. 5 depicts a portion of the cross-sectional view of FIG. 2 showing a leading edge cooling circuit according to various embodiments.

As depicted in FIG. 5, in other embodiments, the flow directions may be reversed. For example, in the leading edge serpentine cooling circuit 130 shown in FIG. 5, a flow of cooling air 132 may be fed radially inward through the leading edge cavity 18B. After passing into the leading edge cavity 18B, the flow of cooling air 132 is directed onto the forward wall 42 of the leading edge cavity 18A via at least one impingement hole 44, providing impingement cooling. A first portion 146 of the post-impingement flow of cooling air 132 flows out of the leading edge cavity 18A to the leading edge 14 of the multi-wall blade 6 via at least one film hole 48 to provide film cooling of the leading edge 14. A second portion 150 of the post-impingement flow of cooling air 132 is directed into the pressure side cavity 20A. In a corresponding manner, a third portion 154 of the post-impingement flow of cooling air 132 is directed into the suction side cavity 22A. The second and third portions 150, 154 of the flow of cooling air 132 are directed into the central cavity 26A and combine into a flow of cooling air 174. The flow of cooling air 174 flows radially inward through the central cavity 26A. The flow of cooling air 174 is further directed through at least one channel to provide tip film. In other embodiments, the flow of cooling air 174, or portions thereof, may be routed to the platform 3 (or inner/outer sidewalls) and/or may be reused in other cooling circuits aft of the leading edge serpentine cooling circuit 130.

The cooling circuits 30, 130 have been described for use in the multi-wall blade 6 of a turbomachine blade 2, which rotates during operation of a gas turbine. However, the cooling circuits 30, 130 may also be used for cooling within stationary turbine nozzles of a gas turbine. Further, the cooling circuits 30, 130 may be used to cool other structures that require an internal flow of cooling air during operation.

Figure 6:
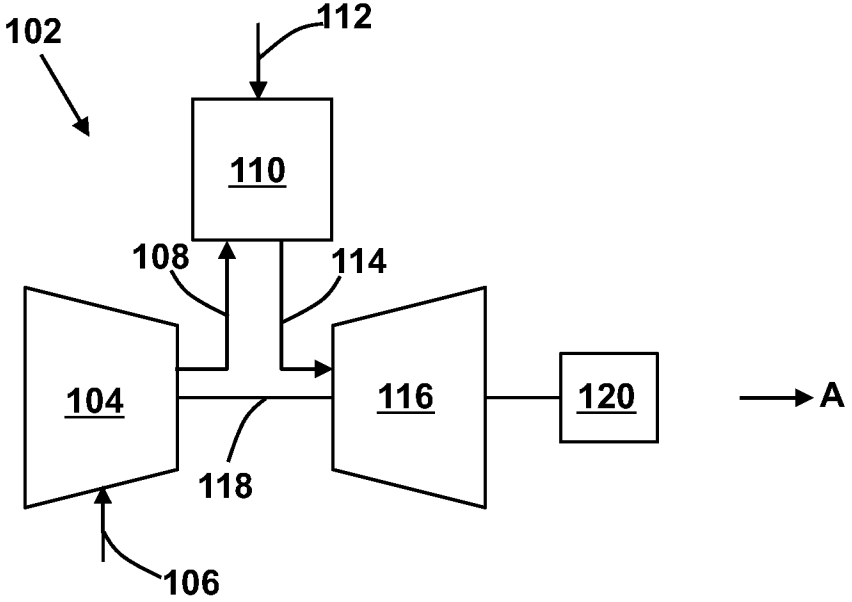
FIG. 6 is a schematic diagram of a gas turbine system according to various embodiments.

FIG. 6 shows a schematic view of gas turbomachine 102 as may be used herein. The gas turbomachine 102 may include a compressor 104. The compressor 104 compresses an incoming flow of air 106. The compressor 104 delivers a flow of compressed air 108 to a combustor 110. The combustor 110 mixes the flow of compressed air 108 with a pressurized flow of fuel 112 and ignites the mixture to create a flow of combustion gases 114. Although only a single combustor 110 is shown, the gas turbine system 102 may include any number of combustors 110. The flow of combustion gases 114 is in turn delivered to a turbine 116, which typically includes a plurality of the turbomachine blades 2 (FIG. 1). The flow of combustion gases 114 drives the turbine 116 to produce mechanical work. The mechanical work produced in the turbine 116 drives the compressor 104 via a shaft 118, and may be used to drive an external load 120, such as an electrical generator and/or the like.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling circuit for a multi-wall blade, comprising:

a pressure side cavity with a surface adjacent a pressure side of the multi-wall blade;

a suction side cavity with a surface adjacent a suction side of the multi-wall blade;

a central cavity disposed between the pressure side and suction side cavities, the central cavity including no surfaces adjacent the pressure and suction sides of the multi-wall blade;

a first leading edge cavity with surfaces adjacent the pressure and suction sides of the multi-wall blade, the first leading edge cavity located forward of the central cavity;

a second leading edge cavity located forward of the first leading edge cavity;

at least one channel for fluidly coupling the central cavity to a tip of the multi-wall blade;

a set of turns for directing a first portion of a flow of cooling air from the second leading edge cavity through the pressure side cavity and into the central cavity; and a set of turns for directing a second portion of the flow of cooling air from the second leading edge cavity through the suction side cavity and into the central cavity;

wherein the first and second portions of the flow of cooling air recombine into a recombined flow of cooling air in the central cavity.

2. The cooling circuit of claim 1, further including at least one leading edge film hole for fluidly coupling the second leading edge cavity to a leading edge of the multi-wall blade.

3. The cooling circuit of claim 1, further comprising at least one impingement opening for fluidly coupling the first leading edge cavity to the second leading edge cavity.

4. The cooling circuit of claim 1, further comprising at least one leading edge film hole, wherein the at least one leading edge film hole extends from the second leading edge cavity to a leading edge of the multi-wall blade.

5. The cooling circuit of claim 4, wherein a third portion of the flow of cooling air is exhausted from the second leading edge cavity to the leading edge of the multi-wall blade through the at least one leading edge film hole to provide film cooling of the leading edge of the multi-wall blade.

6. The cooling circuit of claim 1, wherein at least a portion of the recombined flow of cooling air is exhausted from the central cavity to the tip of the multi-wall blade through the at least one channel to provide film cooling of the tip of the multi-wall blade.

7. The cooling circuit of claim 4, wherein the recombined flow of cooling air in the central cavity flows in a first direction through the multi-wall blade, and wherein the first portion of the flow of cooling air in the pressure side cavity and the second portion of the flow of cooling air in the suction side cavity flow in a second direction through the multi-wall blade.

8. The cooling circuit of claim 7, wherein the first direction is radially outward through the multi-wall blade, and wherein the second direction is radially inward through the multi-wall blade.

9. The cooling circuit of claim 7, wherein the first direction is radially inward through the multi-wall blade, and wherein the second direction is radially outward through the multi-wall blade.

10. An apparatus comprising:

a multi-wall turbine blade; and a cooling circuit disposed within the multi-wall turbine blade, the cooling circuit including:

a pressure side cavity with a surface adjacent a pressure side of the multi-wall blade;

a suction side cavity with a surface adjacent a suction side of the multi-wall blade;

a central cavity disposed between the pressure side and suction side cavities, the central cavity including no surfaces adjacent the pressure and suction sides of the multi-wall blade;

a first leading edge cavity with surfaces adjacent the pressure and suction sides of the multi-wall blade, the first leading edge cavity located forward of the central cavity;

a second leading edge cavity located forward of the first leading edge cavity;

at least one channel for fluidly coupling the central cavity to a tip of the multi-wall blade;

a set of turns for directing a first portion of a flow of cooling air from the second leading edge cavity through the pressure side cavity and into the central cavity; and a set of turns for directing a second portion of the flow of cooling air from the second leading edge cavity through the suction side cavity and into the central cavity;

wherein the first and second portions of the flow of cooling air recombine into a recombined flow of cooling air in the central cavity.

11. The apparatus of claim 10, the cooling circuit further including at least one leading edge film hole for fluidly coupling the second leading edge cavity to a leading edge of the multi-wall blade.

12. The apparatus of claim 10, the cooling circuit further comprising at least one impingement opening for fluidly coupling the first leading edge cavity to the second leading edge cavity.

13. The apparatus of claim 10, the cooling circuit further comprising at least one leading edge film hole, wherein the at least one leading edge film hole extends from the second leading edge cavity to a leading edge of the multi-wall blade.

14. The apparatus of claim 13, wherein a third portion of the flow of cooling air is exhausted from the second leading edge cavity to the leading edge of the multi-wall blade through the at least one leading edge film hole to provide film cooling of the leading edge of the multi-wall blade.

15. The apparatus of claim 10, wherein at least a portion of the recombined flow of cooling air is exhausted from the central cavity to the tip of the multi-wall blade through the at least one channel to provide film cooling of the tip of the multi-wall blade.

16. The apparatus of claim 12, wherein the recombined flow of cooling air in the central cavity flows in a first direction through the multi-wall blade, and wherein the first portion of the flow of cooling air in the pressure side cavity and the second portion of the flow of cooling air in the suction side cavity flow in a second direction through the multi-wall blade.

17. The apparatus of claim 16, wherein the first direction is radially outward through the multi-wall blade, and wherein the second direction is radially inward through the multi-wall blade.

18. The apparatus of claim 16, wherein the first direction is radially inward through the multi-wall blade, and wherein the second direction is radially outward through the multi-wall blade.

19. A turbomachine, comprising:

a gas turbine system including a compressor component, a combustor component, and a turbine component, the turbine component including a plurality of turbomachine blades, and wherein at least one of the turbomachine blades includes a multi-wall blade; and a cooling circuit disposed within the multi-wall blade, the cooling circuit including:

a pressure side cavity with a surface adjacent a pressure side of the multi-wall blade;

a suction side cavity with a surface adjacent a suction side of the multi-wall blade;

a central cavity disposed between the pressure side and suction side cavities, the central cavity including no surfaces adjacent the pressure and suction sides of the multi-wall blade;

a first leading edge cavity with surfaces adjacent the pressure and suction sides of the multi-wall blade, the first leading edge cavity located forward of the central cavity;

a second leading edge cavity located forward of the first leading edge cavity;

at least one channel for fluidly coupling the central cavity to a tip of the multi-wall blade;

a set of turns for directing a first portion of a flow of cooling air from the second leading edge cavity through the pressure side cavity and into the central cavity; and a set of turns for directing a second portion of the flow of cooling air from the second leading edge cavity through the suction side cavity and into the central cavity;

wherein the first and second portions of the flow of cooling air recombine into a recombined flow of cooling air in the central cavity.

20. The turbomachine of claim 19, the cooling circuit further comprising at least one impingement opening for fluidly coupling the first leading edge cavity to the second leading edge cavity.

* * * * *